US005631459A

United States Patent [19]

de Groot

[11] Patent Number: 5,631,459

[45] Date of Patent: May 20, 1997

[54] DEVICE FOR GENERATING IMAGES BY LUMINESCENCE EFFECT

[75] Inventor: Paul de Groot, St. Ismier, France

[73] Assignee: Thomson Tubes Electroniques, Velizy, France

[21] Appl. No.: 439,873

[22] PCT Filed: Nov. 16, 1993

[86] PCT No.: PCT/FR93/01120

§ 371 Date: May 12, 1995

§ 102(e) Date: May 12, 1995

[87] PCT Pub. No.: WO94/13005

PCT Pub. Date: Jun. 9, 1994

[30] Foreign Application Priority Data

Nov. 20, 1992 [FR] France ..... 92 13969

[51] Int. Cl.[6] ..... H01J 40/14

[52] U.S. Cl. ..... 250/214 VT; 250/207; 250/486.1; 313/525

[58] Field of Search ..... 250/214 VT, 207, 250/214.1, 214 R, 98.3, 98.2, 486.1; 313/525, 543, 375, 473

[56] References Cited

U.S. PATENT DOCUMENTS

| | | | |
|---|---|---|---|
| 4,318,122 | 3/1982 | White | 358/41 |
| 4,512,912 | 4/1985 | Matsuda et al. | 252/301.6 S |
| 4,749,903 | 6/1988 | Munier et al. | 313/366 |
| 4,751,423 | 6/1988 | Munter et al. | 313/366 |
| 4,829,355 | 5/1989 | Munier et al. | 357/30 |
| 4,943,254 | 7/1990 | Vieux et al. | 445/28 |
| 4,952,794 | 8/1990 | Kemner et al. | 250/213 |
| 4,960,608 | 10/1990 | Vieux et al. | 427/10 |
| 4,980,561 | 12/1990 | Vieux et al. | 250/486.1 |
| 4,985,633 | 1/1991 | Vieux et al. | 250/486.1 |
| 5,146,076 | 9/1992 | Raverdy et al. | 250/213 |
| 5,298,294 | 3/1994 | Vieux et la. | 427/583 |
| 5,319,189 | 6/1994 | Beauvais et al. | 250/214 |
| 5,338,927 | 8/1994 | de Groot et al. | 250/214 |
| 5,514,874 | 5/1996 | Boone et al. | 250/486.1 |

FOREIGN PATENT DOCUMENTS

| | | |
|---|---|---|
| 2195841 | 3/1974 | France . |
| 2544094 | 5/1976 | Germany . |
| 60-038490 | 2/1985 | Japan . |
| 2170332 | 7/1990 | Japan . |
| 02170332 | 7/1990 | Japan . |

*Primary Examiner*—Stephone Allen

*Attorney, Agent, or Firm*—Oblon, Spivak, McClelland, Maier & Neustadt, P.C.

[57] ABSTRACT

A device for selecting a remanence of output screens of radiological image intensifier tubes. A luminescent screen (ES1) utilizes two phosphor materials (A, B) exhibiting different remanences and different emission spectra. Wavelength-selective optical filters (Fo) are associated with the luminescent screen ES1 in order to select a remanence chosen by transmitting the corresponding spectral band.

14 Claims, 2 Drawing Sheets

DEVICE FOR GENERATING IMAGES BY LUMINESCENCE EFFECT

BACKGROUND OF THE INVENTION

1. Field of the Invention

The invention relates to devices producing images by the effect of excitation of a luminescent screen. It relates more particularly (but not exclusively) to the cathodoluminescent screens of radiological image intensifier tubes (called RII tube for short).

Taking the case of RII tubes for example, these tubes are used mainly in medical imaging, that is to say in the context of radiodiagnosis, where they produce a visible image which conveys the radiological image of a patient.

2. Discussion of Background

FIG. 1 diagrammatically shows conventional radiodiagnosis equipment. This equipment includes a source SX of X-rays delivering radiation RX to which a patient P is exposed.

On the other side of the patient P, that is to say opposite the source SX, the X radiation carrying a radiological image is picked up by an RII tube.

The RII tube generally comprises a vacuum enclosure 2 closed at one end by an entry window FE through which the X radiation penetrates. This X radiation then encounters an entry screen EE, the function of which is to translate the intensity of the X radiation incident at each point of its surface into a number of electrons (not represented).

To this end, the entry screen EE generally comprises a scintillator SC associated with a photocathode PhC.

The scintillator converts the X radiation into visible photons which are themselves converted into electrons by the photocathode.

A set of electrodes DE accelerates these electrons and focuses them onto a cathodoluminescent screen called exit screen ES. The exit screen ES is arranged in proximity to an exit window FS or exit wall situated at the second end of the RII tube, opposite the entry window FE.

The impact of the electrons on the cathodoluminescent screen ES makes it possible to reconstitute the image (amplified in terms of brightness) which, at the outset, was formed on the surface of the photocathode PhC of the entry screen.

The exit window FS is a transparent component generally made of glass (or possibly also consisting of an optical-fibre device), which can be made, for example, from a component fixed onto the envelope of the enclosure 2, or may even constitute a part of this envelope. The exit window FS carries the cathodoluminescent screen ES which, in general, consists of a layer of phosphor material. Under these conditions, the image, in visible light, formed by the cathodoluminescent screen ES is visible from outside the RII tube, through the exit window FS.

The image delivered by the cathodoluminescent exit screen ES is generally viewed via an optical device DO, arranged outside the RII tube, centred, for example, on a longitudinal axis 5 of the RII tube, around which axis the cathodoluminescent screen ES is also centred.

This image may possibly be distributed by the optical device Do, on the one hand, towards various image detectors, such as, for example, cinematographic and photographic imaging cameras marked 6, 7, respectively, arranged on either side of the optical device Do on a second axis 8 perpendicular to the axis 5 of the tube, and, on the other hand, towards an image detector consisting of a television imaging camera CT.

The television camera CT is linked to a visual display device DV capable, in "direct" mode, of displaying the image which is delivered in the form of electrical signals by the television camera CT (in the case of radioscopy). In the example represented, the camera CT is also linked to a signal acquisition and processing device ATS which can store and process the signals, in digital form, relating to the image (in the case of digital radiography) and possibly correct the image displayed by the visual display device DV.

Equipment like that shown in FIG. 1 is currently used successively in fluoroscopy or radioscopy mode, and in digital radiography mode. However, these two modes pose different problems.

In the case of digital radiography, the doses of X-rays are often significant (and the duration of application of the radiation is very short (a few milliseconds)). The repetition rate of the images is variable according to the applications, from a few images per second up to television frequency, and the image resolution sought is the highest possible.

In the case of fluoroscopy or radioscopy, the radiological imaging system shown in FIG. 1 operates at the television frequency (25 or 30 images/s), with X-radiation doses which are much weaker, however the resolution of the details sought is lower. Due to the weak doses of X radiation used, the spatial-temporal fluctuation (quantum fluctuation of the X radiation) is perceptible in the video image delivered via the radiological imaging system. In order to limit this fluctuation, and enhance the quality of the image, it is necessary to perform time-based integration of the luminous intensity at each point of the image, in order to obtain a "smoothing" of the apparent time-based noise. Obviously, a practical compromise exists between an integration time which is sufficient to reduce the noise, and an integration time which is short enough not to introduce "blurring" around the image of the moving organs (smearing effect).

In order to obtain attenuation of the perceptible noise, in fluoroscopy, several solutions are currently employed:

a—Use of a television imaging camera equipped with a remanent tube.

b—The use of a remanent luminescent tube at the output from the image intensifier tube.

c—The use of image processing, on the basis of a partial cumulation of the video signal from each point of the image, for several successive frames.

As far as the first two solutions (a) and (b) are concerned: they exhibit the drawback of optimizing the radiological imaging system for radioscopy, to the detriment of its use in digital radiography. In fact, in digital radiography, it is desirable for the remanence (persistence of the luminescence) to be as low as possible, particularly in order to reduce the "blurring" which this remanence would introduce for the observation of moving organs (heart, for example) or the introduction of opacifying agents. It should be noted that, at the present time, television imaging cameras are today increasingly equipped with photosensitive sensors of the CCD type (from "Charge Coupled Device") which introduce very low remanence, and which are therefore able to pick up images in "high-speed" mode, that is to say in digital radiography mode, but which, without digital integration, produce images which are too noisy in fluoroscopy mode.

As far as the third solution (c) is concerned: it entails cumbersome and expensive facilities, especially for implementing a high-resolution image memory.

SUMMARY OF THE INVENTION

In order to respond to these problems, it is an object of the present invention to produce at least two visible images simultaneously via the RII tube, which exhibit different remanences, and to select the visible image having the remanence which is most appropriate to the operating mode envisaged (radioscopy or digital radiography).

To this end, the invention proposes, on the one hand, producing the luminescent screen of the image generator (or exit screen in the case of an RII tube), by the use of a mixture of at least two phosphor materials which differ both in their remanence and in the frequency range of their spectral emissions.

In this configuration, the radiation emitted by the luminescent screen, at each of its points corresponding to an elementary image surface, consists of the addition of radiation with different spectral composition and with different remanence, the number of the different radiation types being the same as the number of different phosphor materials.

Under these conditions, with the different phosphors being subjected to the same excitation radiation, they emit light in response, corresponding to different spectral bands or "colours", each containing the same image, "each colour" corresponding to a different remanence. If care is taken to choose the different emission spectra in such a way that they are not superimposed to any significant extent, it then becomes possible to observe an image having the chosen remanence by selecting the colour to which it corresponds, by the use of an optical filter.

The excitation radiation consists of any radiation capable of generating the luminescence phenomenon with phosphors. This excitation radiation is formed by electrons emitted by a photocathode PhC in the case of an RII tube and, in this case, the image produced by the exit screen ES is received by one (or more) image detectors. However, the invention may also be applied to other cases, for example to cathode ray tubes, ("CRT" for short) and in that case the electrons are produced by an electron gun and bombard or excite a mixture of different phosphor materials carried by the visual display screen of the CRT.

The invention thus relates to an image generator device including a luminescent screen subjected to excitation radiation, characterized in that the luminescent screen includes a mixture of at least two phosphor materials emitting with different emission spectra and with different remanences.

BRIEF DESCRIPTION OF THE DRAWINGS

The invention will be better understood on reading the description which follows, given by way of non-limiting example by reference to the attached drawings, among which.

DETAILED DESCRIPTION OF THE PREFERRED EMBODIMENT

Figure 1:
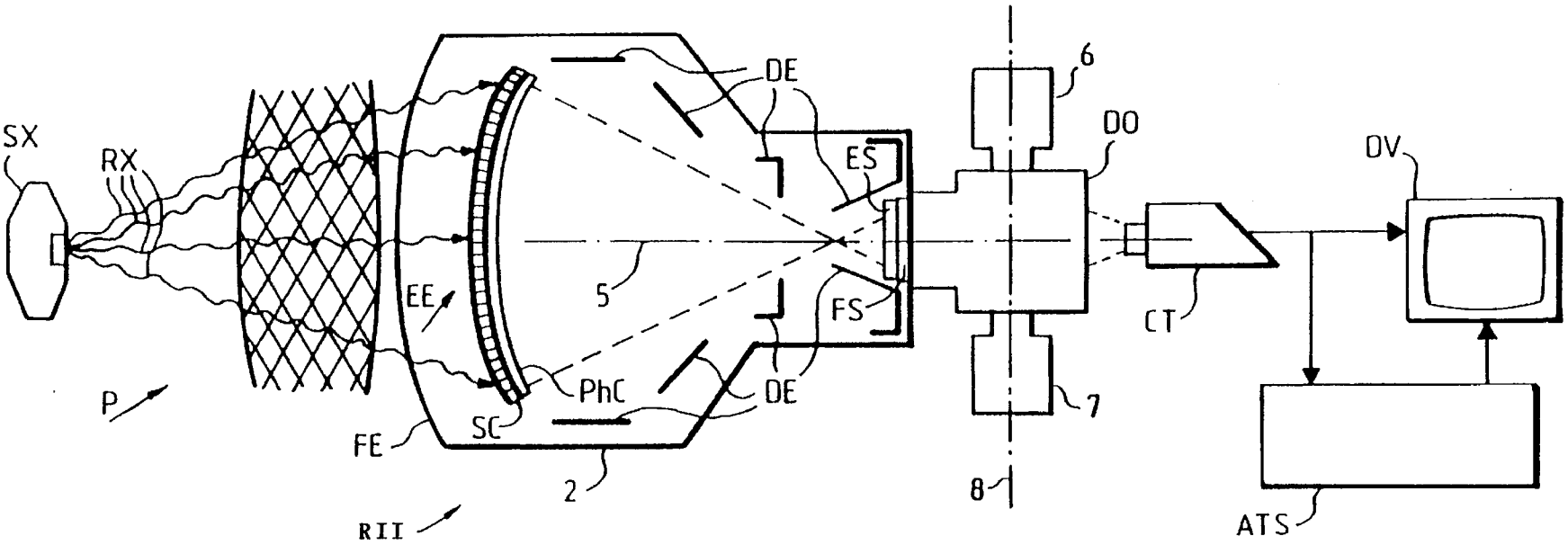
FIG. 1, already described, diagrammatically shows X-ray medical imaging equipment using a conventional RII tube to produce a visible image.
Figure 2:
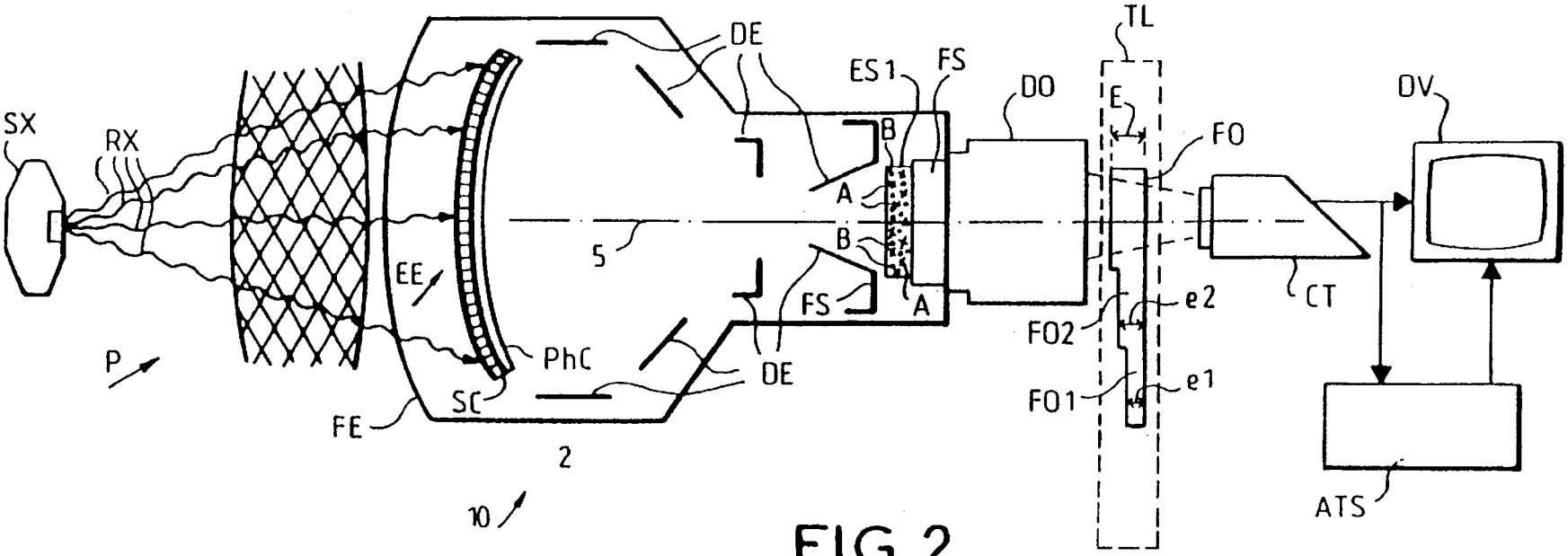
FIG. 2 diagrammatically shows medical imaging equipment using an RII tube in accordance with the invention.

FIG. 2 represents an RII tube 10 constructed in such a way as to produce images in accordance with the invention. The RII tube 10 is used in medical imaging equipment 11 including a source SX producing X radiation RX. In the same way as in the case explained by reference to FIG. 2, the X radiation passes through a patient P to be examined, then encounters the RII tube 10. It passes through the entry window FE of the tube 10 then encounters the entry screen EE of the latter. This entry screen is conventional and, as in the example of FIG. 1, in response to the X radiation, it produces electrons (not represented) which are accelerated by a set of electrodes DE towards the exit window FS of the RII tube. In proximity to the exit window FS, these electrons are focused onto a cathodoluminescent screen or exit screen ES1 which, by the effect of the electron bombardment, emits in the visible.

According to one characteristic of the invention, the cathodoluminescent screen ES1 is constructed by using at least two different luminescent materials A, B, so that, at each of the points of the cathodoluminescent screen ES1 corresponding to an elementary image surface, the two different phosphor materials A, B exist. In FIG. 2, the two phosphor materials A, B are represented by crosses and dots respectively.

The various phosphor materials which constitute the cathodoluminescent screen ES1 are chosen, on the one hand, to emit in the visible with different remanences, and, on the other hand, to have different emission spectra, that is to say to emit at different wavelengths and thus at different colours.

By the effect of the excitation by the electrons originating from the photocathode PhC, the cathodoluminescent screen ES1 simultaneously produces several monochrome images of different colours (as many as there are different phosphor materials to constitute the cathodoluminescent screen) which each reproduce the image initially formed on the photocathode PhC.

Under these conditions, each monochrome image exhibits a different remanence from those presented by the monochrome images of another colour. The images produced by the cathodoluminescent screen ES1 are visible from outside the RII tube 10 through the exit window FS, and it is then easy to transmit images having the desired remanence towards at least one image detector (or the eye of an observer), by favouring the transmission of the light having the corresponding colour, as is explained further in the rest of the description.

As in the example of FIG. 1, an optical device DO situated outside the RII tube 10 on a longitudinal axis 5 of the latter, picks up the images delivered by the cathodoluminescent screen ES1 and transmits them to an image detector CT also arranged along the longitudinal axis 5. The image detector CT is linked to a visual display device DV and to a signal acquisition and processing device ATS, so as to allow it to operate either in fluoroscopy mode (radioscopy), or in digital radiography mode. The image detector CT consists, for example, of a television imaging camera the sensor (not represented) of which is of the CCD type, so that it adds no remanence to that of the image received.

According to one characteristic of the invention, a device for transmitting the light TL acting selectively on the light transmission as a function of its wavelength, is arranged between the camera CT and the optical device DO, for the purpose of determining the remanence of the images received by this camera. To this end, the transmission device TL includes at least one optical filter Fo acting in the spectral band corresponding to one of the colours emitted by the cathodoluminescent screen ES1. An optical filter Fo may, for example, be either of the coloured filter type, having the colour of the spectrum to be transmitted with the minimum attenuation, or of the interferential filter type which, with respect to the previous one, offers the advantage of having steeper transition slopes between the parts of the spectra which are transmitted and not transmitted.

Assuming, to simplify the description, that the cathodoluminescent screen ES1 is constructed by using only two different phosphor materials (which may constitute the most widespread embodiment), so as to emit with two different remanences simultaneously:

the first phosphor material A may, for example, be of $Y_2O_3$: Eu (corresponding to the phosphor P56 according to the international "JEDEC" reference), emitting a red light centred on the 0.620 micrometer wavelength, with a remanence or persistence of the order of 1 millisecond, which is suitable in the case of digital radiography.

the second phosphor material B may, for example, be of $ZnSiO_4$: Ce (corresponding to the phosphor P39 according to the international "JEDEC" reference), emitting a green light centred on the 0.550 micrometer wavelength, with a remanence of the order of 60 milliseconds which is very suitable in the case of radioscopy.

The phosphor materials A and B are generally in the form of powder at the outset, so that the cathodoluminescent screen ES1 can be produced, for example, as one layer in the same way as in the prior art, except that in the case of the invention this layer comprises the two previously mixed powders of A and B phosphor materials. Obviously, it is also possible to superimpose different layers (not represented) each containing only one of the phosphor materials A, B. The latter embodiment itself also corresponds, at the level of each elementary image surface, to a mixture of the phosphor materials A, B.

With the red and green monochrome images being emitted simultaneously, respectively for the A and B phosphors which constitute the cathodoluminescent screen, if an optical filter Fo is interposed so as to let through one or the other of the red or green radiations selectively, it is possible to transmit only the light the remanence of which is best adapted to the use of the radiological system towards the television camera CT.

On this principle, it is thus possible to make the cathodoluminescent screen by using two or three or more different phosphor materials, exhibiting different remanences and different emission spectra, and to provide the same number of optical filters Fo each corresponding to one of the emission spectra, so as to select the chosen remanence.

However, particularly when the cathodoluminescent screen ES1 includes only two different phosphor materials A, B emitting, for example, in the red and the green respectively, as in the example of FIG. 1, two different remanences can be obtained by using a single optical filter Fo, according to whether the latter is interposed or not.

In fact, if an optical filter Fo is interposed which does not let the green pass through, the camera CT receives only the red, the remanence of which is negligible. This corresponds to operation in digital radiography mode.

If no optical filter is interposed, the camera CT receives the two red and green monochrome images, the green image exhibiting strong remanence. Under these conditions, the overall image (given by the superimposition of the red and green monochrome images) may be considered by the eye as having high remanence (exhibiting low noise), if the percentage of green light is sufficiently large with respect to that of the red light. This case corresponds therefore to operation in radioscopy mode.

Such a configuration in which two remanences can be selected successively by the use of a single optical filter Fo which is or is not interposed may be obtained, for example, with A and B phosphor materials corresponding respectively to the P56 type and to the P39 type as mentioned previously, mixed in proportions by weight of about 10 to 50% for the A phosphor and of about 50 to 90% for the B phosphor.

In practice, in order to obtain the maximum radiation intensity on the camera CT for the application requiring the maximum sensitivity, a mixture of A, B luminescent powders may be chosen in such a way that the remanence of the mixture, in the absence of any optical filtering, corresponds to the optimum remanence for this application. In the case of the application in radiological imaging, the remanence of the mixture will be optimized for fluoroscopy which requires the maximum sensitivity, due to the low X-radiation doses employed.

It should therefore be noted that the metering of the proportion of the A and B phosphor materials used to constitute the cathodoluminescent screen ES1 makes it possible, on emission by the latter, to obtain any (overall) remanence value desired, lying between the values which are each specific to the constituents of this screen ES1.

Obviously, the metering of the different A and B phosphor materials should also take account of the luminous efficiency specific to each of these materials.

Moreover, depending on the spectral transmission characteristic of the optical filter Fo, and on the spectral radiation characteristics of each of the phosphors, it is possible to obtain any desired remanence value, lying between the remanence values specific to each of the A and B phosphor materials which constitute the cathodoluminescent screen or exit screen ES1.

In fact, as already explained above, if no optical filter Fo is interposed, in the case of the example presented, the maximum remanence is obtained due to the fact that the maximum amount of green light (with high remanence) reaches the camera CT. By interposing a wavelength-selective optical filter Fo, not acting on the red light, but acting on the green light in such a way as to transit a quantity thereof lying between the maximum and the minimum, the ratio of the high-remanence light to the low-remanence light in the light received by the camera CT is altered, and thus the "overall" remanence resulting therefrom for the eye is altered.

To this end, it is sufficient, for example, to arrange at least one optical filter Fo of the coloured filter type, coloured red in this example, and the thickness E of which is less than the thickness necessary to totally absorb the light of the other colour, namely in this example the green light.

If several such optical filters acting substantially in the same wavelength range are set up, with similar or different attenuation powers, a choice of possible remanence values is obtained, the number of which is the same as that of the various attenuation values capable of being obtained by each of the optical filters, and for the combinations of these filters.

Such a set of optical filters may consist, for example, of separate filters, possibly superimposable in order to add their attenuation, or alternatively for example of a coloured filter Fo, the thickness (and thus the transmission) of which varies, progressively or otherwise. FIG. 2 illustrates such an embodiment, showing an optical filter Fo of the "coloured filter" type, including several thicknesses E, e1, e2 produced in the form of steps: for example, the thickness E is the maximum thickness of the optical filter Fo, and it allows maximum attenuation of the transmission of the light not having the colour of the filter; this results in the lowest remanence. On the other hand, the thicknesses e1, e2, which are increasingly small with respect to the maximum thickness E, represent a first and a second intermediate optical filter Fo1, Fo2 respectively which attenuates less and less, and make it possible to obtain two different remanence values, values which are intermediate between the minimum value and the maximum value which is obtained when no filter is interposed.

The embodiments of the invention indicated in this description are given by way of non-limiting example. For example, the values of the proportions of the constituents indicated, and likewise the nature of the phosphors employed, are given here only by way of indication and do not limit the scope of the invention. A wide choice of phosphor materials can be used, and the proportions must be optimized in each case on the basis of these materials, of the technology for producing the exit screen of the tube, of the other components of the radiological image suite, and of the result sought.

It should be noted moreover that the description has been given with reference to a radiological imaging device, but that the invention can be implemented advantageously in other applications, especially when it is beneficial to have the possibility of attenuating the noise appearing in an image resulting from the detection of a small number of photons, for example for low-light-level television (night-time television), or also neutron or gamma-radiation imaging, or ultraviolet or infrared radiation imaging, etc.

I claim:

1. An image generating device including a luminescent screen with at least two phosphor materials emitting light with different emission spectra and different remanences wherein said generator device functions in modes producing images resulting from the detection of radiation having different fluctuation levels, said device comprising:

at least one image detector;

a light transmission device inserted between the luminescent screen and the image detector wherein said transmission device includes removable filter means for wavelength-selectively altering the quantity of light produced by the luminescent screen and directed towards the image detector whereby the remanence which is most appropriate to the level of detected radiation is selected.

2. Image generator device according to claim 1, characterized in that the remanence of the light produced by at least one of the two phosphor materials (A, B) is greater than 10 milliseconds.

3. Image generator device according to claim 1, characterized in that the image detector (CT) is a television imaging camera.

4. Image generator device according to claim 1, characterized in that the luminescent screen (ES1) constitutes a cathodoluminescent screen or an output screen of a radiological image intensifier tube.

5. Image generator device according to claim 1, characterized in that the luminescent screen (ES1) constitutes a cathodoluminescent screen of a cathode ray tube.

6. Image generator device according to claim 1, characterized in that the filter means for modifying the quantity of light transmitted include at least one optical filter of the type having little effect on the transmission of the light in a wavelength range corresponding to a first colour of light produced by one of the phosphor materials called first phosphor (A) and reducing the transmitted quantity of light of a second colour produced by another phosphor material (B) called second phosphor.

7. Image generator device according to claim 6, characterized in that the optical filter reduces the transmission of the light having the second colour to the point of substantially suppressing said second color light.

8. Image generator device according to claim 6, characterized in that said at least one optical filter is of the interferential filter type.

9. Image generator device according to claim 6, characterized in that it includes at least two optical filters acting on the transmission of the light produced by the second phosphor (B).

10. Image generator device according to claim 6, characterized in that at least one optical filter is of the filter type, coloured to the colour to be transmitted with the minimum attenuation.

11. Image generator device according to claim 10, characterized in that said at least one optical filter includes at least two thicknesses corresponding to different attenuations of the light.

12. Image generator device according to claim 6, characterized in that the light produced by the second phosphor (B) has a greater remanence than that produced by the first phosphor (A).

13. Image generator device according to claim 12, characterized in that the quantity of light produced by the second phosphor (B) is different from that produced by the first phosphor (A).

14. Image generator device according to claim 12, characterized in that the quantity of light produced by the second phosphor (B) is greater than that produced by the first phosphor (A).

* * * * *